US006494385B1

(12) United States Patent
Chen

(10) Patent No.: US 6,494,385 B1
(45) Date of Patent: Dec. 17, 2002

(54) CONTROLLING DEVICE FOR ROTATING SPRINKLER

(76) Inventor: Hung-Ming Chen, No. 18, Lane 1100, Sec. 1, Li Ming Rd., Taichung City (TW)

( * ) Notice: Subject to any disclaimer, the term of this patent is extended or adjusted under 35 U.S.C. 154(b) by 0 days.

(21) Appl. No.: 09/935,820

(22) Filed: Aug. 23, 2001

(51) Int. Cl.[7] ..... B05B 3/08

(52) U.S. Cl. ..... 239/233; 239/97; 239/225.1; 239/230; 239/236; 239/590.5; 239/DIG. 1

(58) Field of Search ..... 239/97, 101, 201, 239/207, 225.1, 230, 231, 232, 233, 236, 503, 509, 511, 590.5, DIG. 1

(56) References Cited

U.S. PATENT DOCUMENTS 3,871,582 A * 3/1975 Biddle ..... 239/233
3,884,416 A * 5/1975 King ..... 239/230
4,281,793 A * 8/1981 DeWitt ..... 239/97
4,462,545 A * 7/1984 Lourenco ..... 239/236
4,819,875 A * 4/1989 Beal ..... 239/230
4,907,742 A * 3/1990 Whitehead et al. ..... 239/230
5,370,311 A * 12/1994 Chen ..... 239/230
5,647,541 A * 7/1997 Nelson ..... 239/230

* cited by examiner

*Primary Examiner*—Steven J. Ganey
(74) *Attorney, Agent, or Firm*—Hedman & Costigan, P.C.

(57) ABSTRACT

A controlling device for a rotating sprinkler is composed of a sleeve (10), a compressing block (21), a spring (22), a controller (23), a rotator (24), a cushion (25), and a shelter ring (26). The rotator (24) rotates with a rotating sprinkler (50) synchronously and operates with the controller (23) to construct a gap selectively therebetween so that a quantity of water flowing into the rotating sprinkler (50) is changed when the gap is formed or not. Whereby the controlling device arranges a substantially rectangular spraying arrangement of the rotating sprinkler (50).

11 Claims, 6 Drawing Sheets

CONTROLLING DEVICE FOR ROTATING SPRINKLER

BACKGROUND OF THE INVENTION

1. Field of the Invention

The present invention relates to a controlling device for a rotating sprinkler that is connected between a water outlet and a rotating sprinkler, and having a substantially rectangular spraying range achievable by varying the quantity of spraying water therefrom.

2. Description of Related Art

Rotor-type sprinklers are widely used for watering lawns, golf courses, athletics fields, and more particularly for nursery gardening and agricultural farming to irrigate the land. The use of multiple rotor-type sprinklers is well known in the aforementioned situations and therefore, descriptions of the structure and the operation of the rotor-type sprinklers are omitted.

Generally speaking, conventional rotor-type sprinklers are connected to a water source, normally a faucet. Pressure of sprayed water from the water source drives the conventional rotor-type sprinklers to rotate and spray the water in a circular range. Referring to FIG. 6, the conventional rotor-type sprinklers are arranged in two different types that have some restrictions which are listed as following:

1. First type: The margins of the circular spraying ranges of the rotor-type sprinklers (90) are tangential, as shown in the left side portion of FIG. 7, whereby a dry area (91) is caused due to not being within the watering range. Therefore, this arrangement of the conventional rotor-type sprinklers is not usually used.

2. Second type: A high-density arrangement of the rotor-type sprinklers (90) is shown in the right side portion of FIG. 7. Although all areas of the field are irrigated, multiple overlapped areas (92) are too damp because the overlapped areas (92) are watered twice, whereby water is wasted and plants in the field grow unevenly and possibly unhealthily due to the excess water. Besides, the high density arrangement needs more rotor-type sprinklers which results in high costs, and water pipes in accordance with the rotor-type sprinklers are necessarily complex which in turn causes more trouble in construction.

The present invention has arisen to mitigate and/or obviate the disadvantages of the conventional rotor-type sprinkler.

SUMMARY OF THE INVENTION

The main objective of the present invention is to provide a controlling device for a rotating sprinkler that makes the spraying range of the rotating sprinkler defined as a rectangle so as to enable efficient abutment of neighboring irrigation plots.

Further benefits and advantages of the present invention will become apparent after a careful reading of the detailed description with appropriate reference to the accompanying drawings.

DETAILED DESCRIPTION OF THE INVENTION

Figure 1:
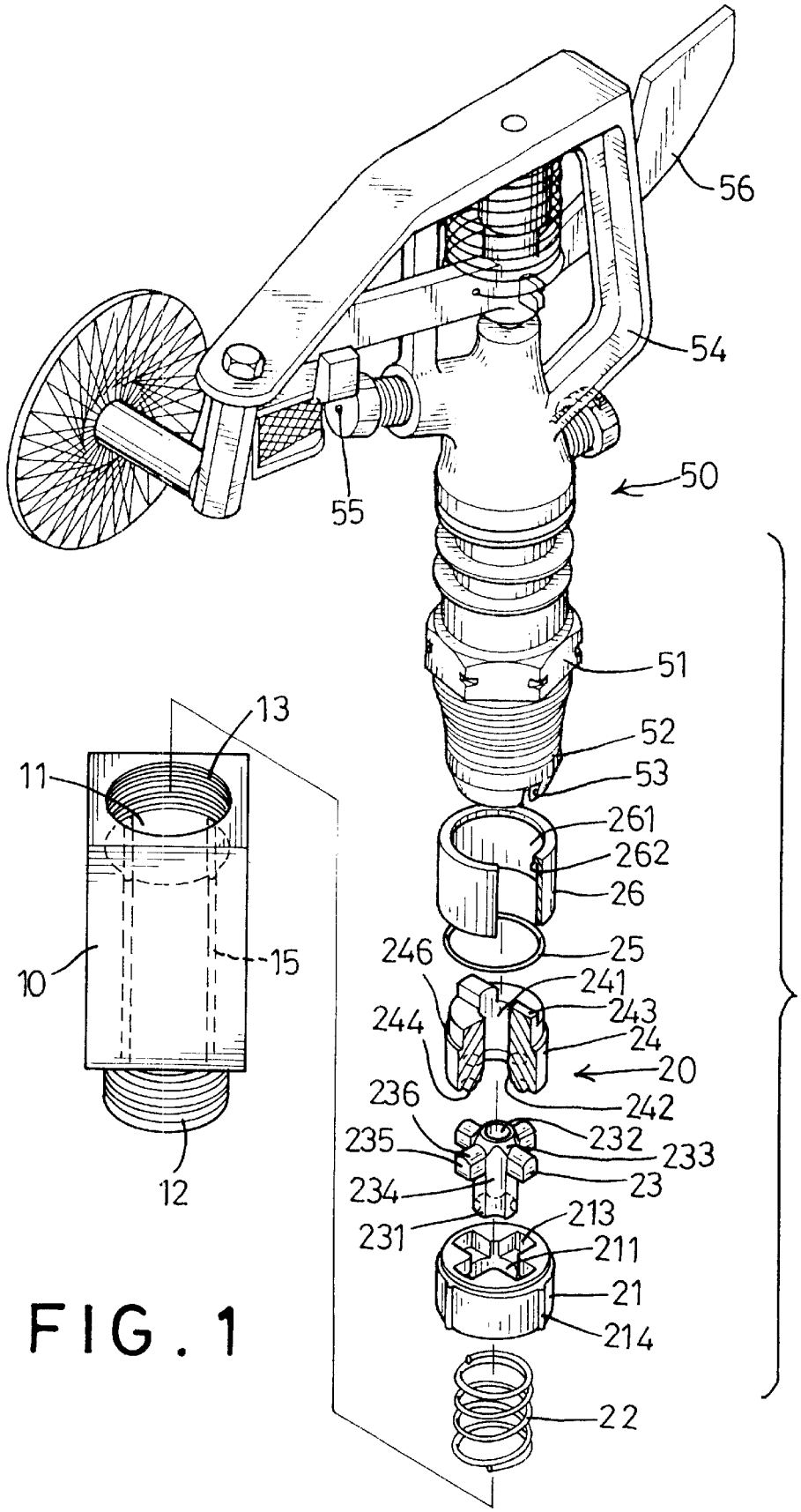
FIG. 1 is an exploded perspective view of a controlling device for a rotating sprinkler in accordance with the present invention.
Figure 2:
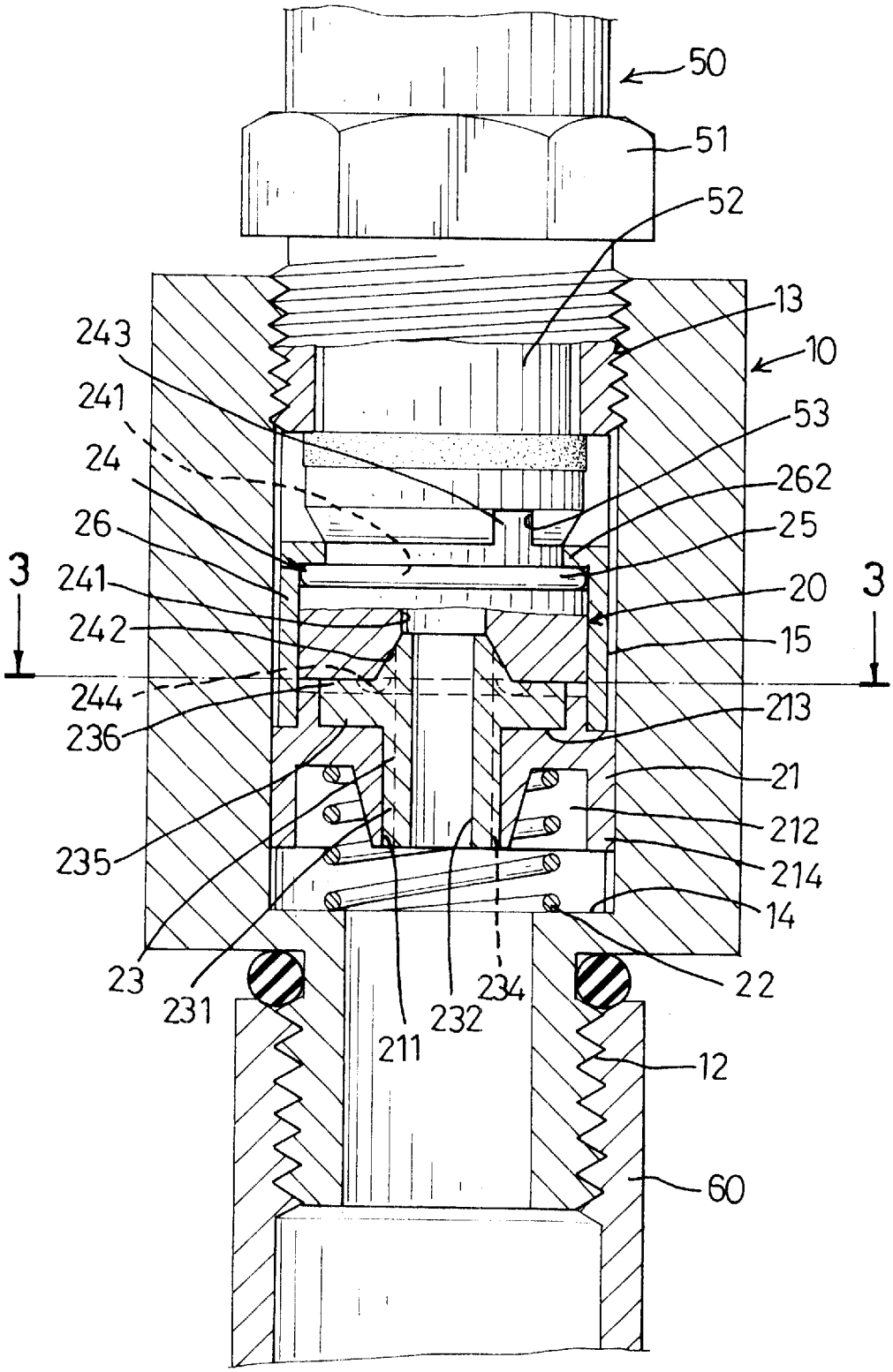
FIG. 2 is a partially cross-sectional side view of the controlling device for a rotating sprinkler in assembly.

With reference to FIGS. 1 and 2, a controlling device is adapted to be secured between a rotating sprinkler (50) and a water pipe (60) and is composed of a sleeve (10) and a controlling device (20) secured inside the sleeve (10).

The rotating sprinkler (50) has a screw head (51), a hollow axle (52) rotatably penetrating the center of the screw head (51), two cutouts (53) each oppositely defined in a distal bottom end of the axle (52), a striking rack (54) mounted on a top end of the axle (52), a nozzle (55) communicating with the axle (52) and secured at a front end of the striking rack (54), and a pendulous element (56) transversally and pivotally secured with the striking rack (54).

When the nozzle (55) sprays, the pendulous element (56) is pushed and vibrated by the recoil force which caused when water is sprayed out. The recoil-force from the nozzle (55) makes the pendulous element (56) knock on the striking rack (54) so that the rotating sprinkler (50) rotates a little bit. Then, the rotating sprinkler (50) turns little by little to rotate around and spray water in all direction. The rotating sprinkler (50) used in this invention is not limited in a certain spraying type. For example, the rotating sprinkler (50) can be a foggy type or dropped type (a round scattering plate secured on a distal end of the nozzle (55)) to connect to the rectangular spray controlling device.

The sleeve (10) is quadratic prism which has an exterior indicator that marks the location of the controlling set (20) and has a tube chamber (11) defined longitudinally therein. A threaded boss (12) is formed outwardly at a bottom end of the sleeve (10) to communicate with the water outlet (60) and a thread hole (13) is defined in a top end of the sleeve (10) to connect with the screw head (51) of the rotating sprinkler (50). Multiple trenches (15) are defined in an inner wall of the tube chamber (11) and a resisting edge (14), as shown in FIG. 2, is transversally formed at a bottom wall of the tube chamber (11) to block the controlling set(20) inside the sleeve (10).

The controlling set (20) is composed of a compressing block (21), a spring (22), a controller (23), a rotator (24), a cushion (25), and a shelter ring (26). The spring (22) is mounted on the resisting edge (14) of the sleeve (10) and sandwiched between the threaded boss (12) and the compressing block (21).

The compressing block (21) is a cylinder and has an axle hole (211) defined in the center of the compressing block (21). A spring recess (212) is defined in a bottom portion of the compressing block (21) to receive part of the spring (22) inside. A cross-recess (213) is defined in a top portion of the compressing block (21) and communicated with the axle hole (211). Additionally, multiple ridges (214) are formed on an outer wall of the compressing block (21) to match up with corresponding trenches (15) of the sleeve (10) so as to avoid rotating of the compressing block (21) relative to the sleeve (10).

The controller (23) is combined with the compressing block (21) and has an axle tube (231) to mate with the axle hole (211) of the compressing block (21). A waterway (232) is axially defined in the axle tube (231) to communicate with the tube chamber (11) of the sleeve (10). A first inclined face (233) is formed on a top edge of the axle tube (231) and four arms (235) protrude from the periphery of the axle tube (231) near the first inclined face (233) and rest inside the cross-recess (213) of the compressing block (21). The arms (235) are arranged at isogonal 90 degrees and each arm (235) has a curved surface (236) defined at top thereof such that the curved surface (236) is higher than a top surface of the compressing block (21). Four sub-waterways (234) are defined in an outer periphery of the axle tube (231) to selectively allow water to flow therethrough.

The rotator (24) is mounted on the controller (23) and has a channel (241) defined in the rotator (24) to communicate with the waterway (232) of the controller (23). A second inclined face (242) is constructed on a bottom face near the waterway (232) to correspond with the first inclined face (233) of the controller (23). Two wedges (243) extend upwardly from a top face of the rotator (24) to insert into the cutouts (53) of the rotating sprinkler (50) and four stubs (244) are formed at a bottom face of the rotator (24) at isogonal angles of 90 degrees. Additionally, a protruding edge (246) is formed on an outer periphery of the rotator (24).

The shelter ring (26) sleeves around the rotator (24) and has an aperture (261) to receive the rotator (24) inside. A flange (262) is formed on an inner wall of the shelter ring (26) to block the rotator (24) and prevent the rotator (24) from moving away from the controller (23). The cushion (25) made of metal is sandwiched between the protruding edge (246) of the rotator (24) and the flange (262) of the shelter ring (26).

Figure 3:
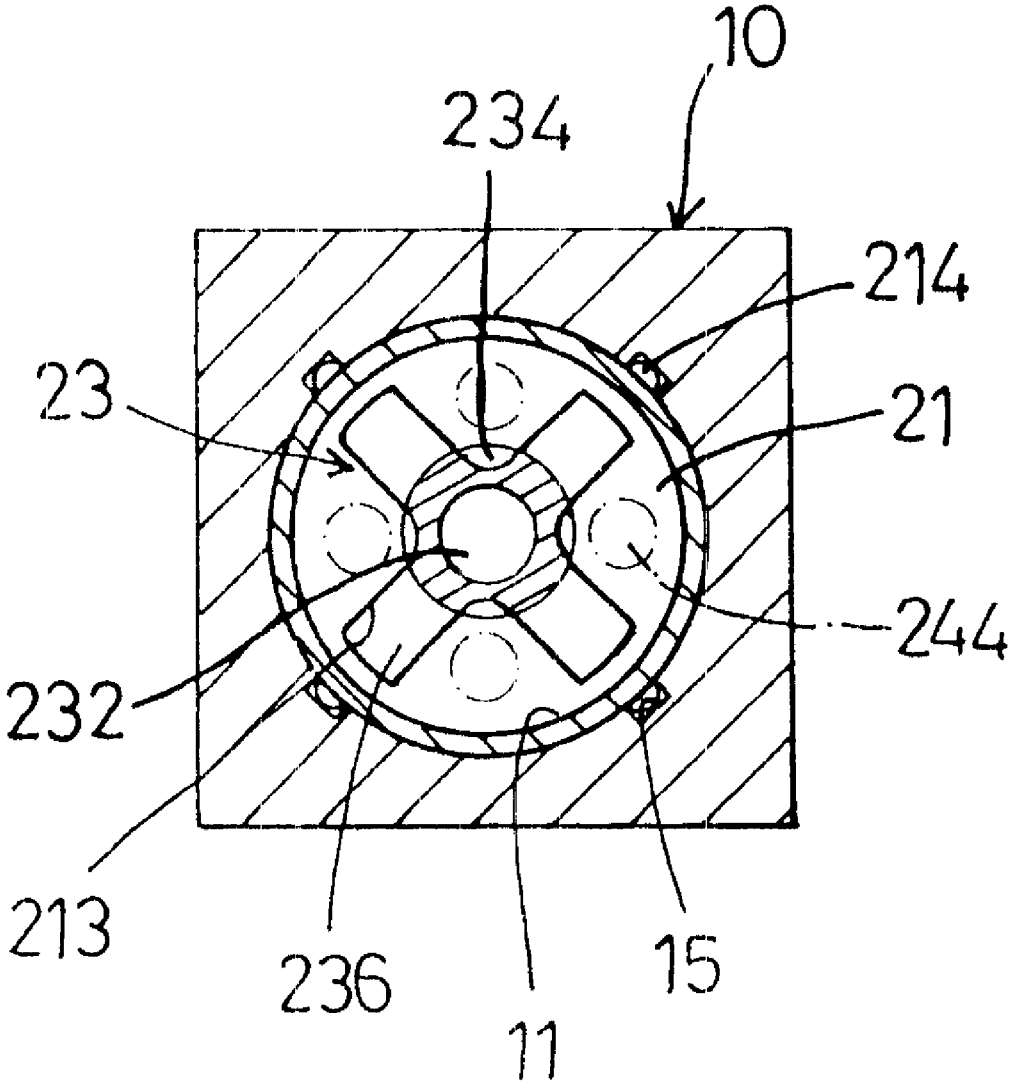
FIG. 3 is a top cross-sectional view of the controlling device for a rotating sprinkler in accordance with line 3—3 in FIG. 2.

Now reference with FIGS. 1, 2, and 3, when the controlling device for the rotating sprinkler is in use and connected to the rotating sprinkler (50) and the water outlet (60), the rotator (24) rotates simultaneously with the axle (52) of the rotating sprinkler (50) because the wedge (243) of the rotator (24) extends into the cutouts (53) of the rotating sprinkler (50). The rotator (24) continuously engages a top surface of the compressing block (21) and curved surface (236) of the arms (235), which result in an axial up and down movement of the rotator (24) inside the shelter ring (26). During the engagement between of the stubs (244) of the rotator (24) and the top surface of the compressing block (21), the first inclined face (233) of the controller (23) is connected to the second inclined face (242) of the rotator (24) in a water-tight manner to block the sub-waterway (234) so that water can only flow through the waterway (232) in the center of the controller and goes up to the rotating sprinkler (50) to spray out.

Figure 4:
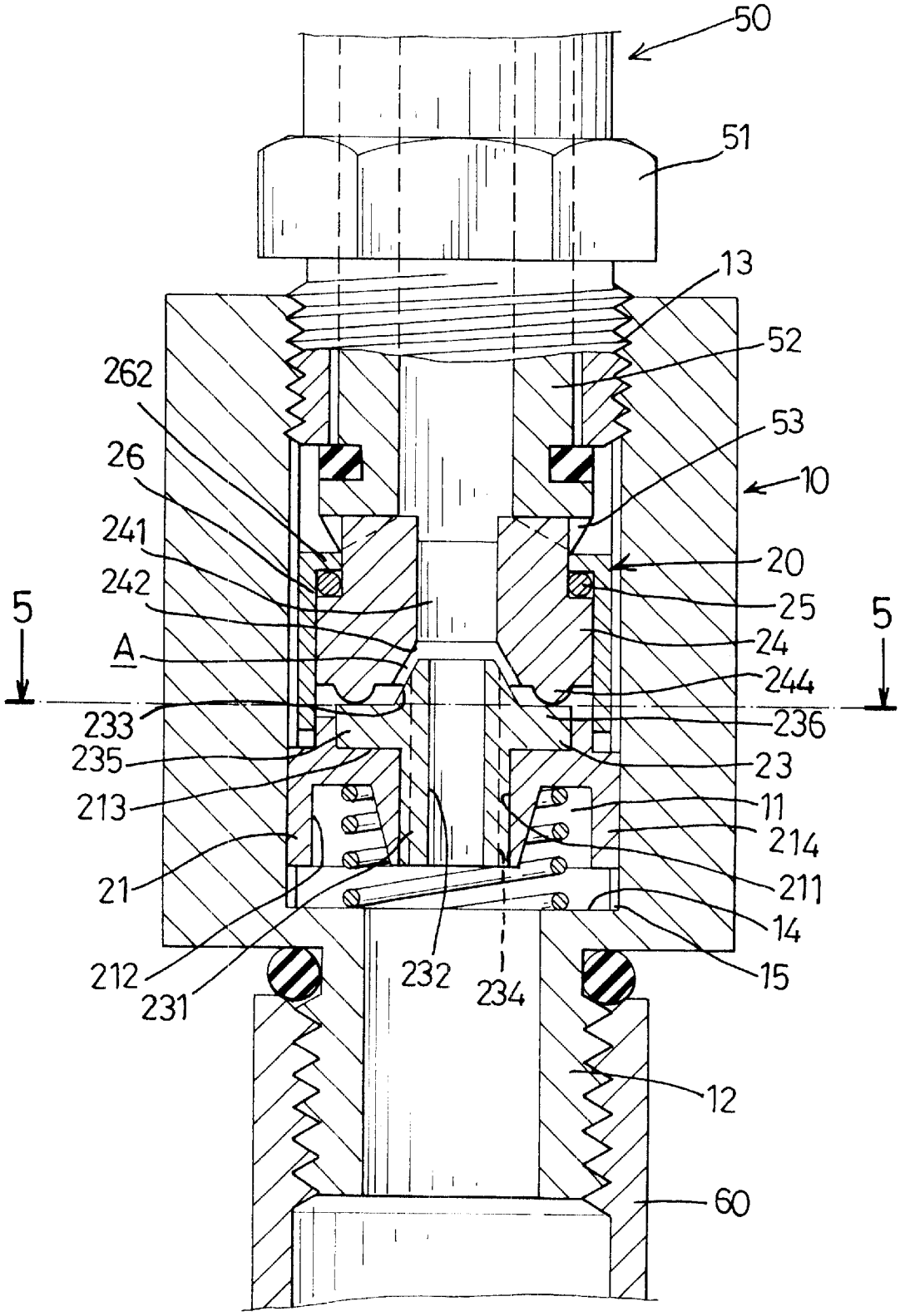
FIG. 4 is an operational side view with partial in cross section, wherein water is shown to flow through a main waterway and sub-waterways.
Figure 5:
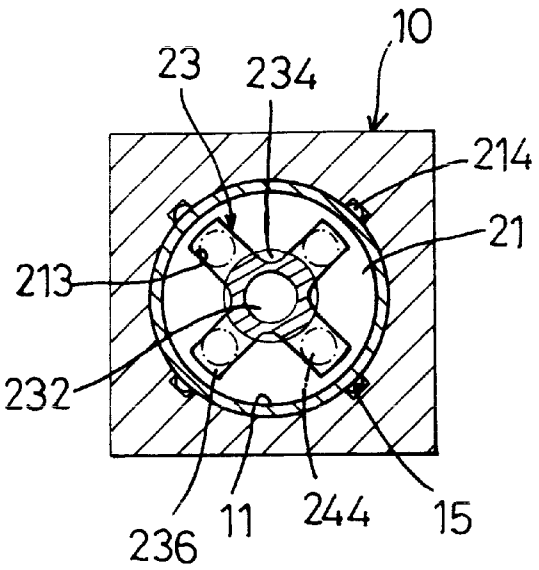
FIG. 5 is a top cross-sectional view of the controlling device for a rotating sprinkler in accordance with line 5—5 in FIG. 4.

In FIGS. 4 and 5, during the engagement between of the stubs (244) of the rotator (24) and curved surface (236) of the arms (235), the first inclined face (233) of the controller (23) is separated from the second inclined face (242) of the rotator (24) so that the water-tight manner is eliminated. At that time, the stubs (244) push the controller (23) down via the arms (235) with the spring (22) compressed. Then a gap (A) is constructed between the first inclined face (233) of the controller (23) and the second inclined face (242) of the rotator (24) so that water flows through waterway (232) and sub-waterways (234). Therefore, quantity of the water flowing into the rotating sprinkler (50) increases so as to make the spraying range of the rotating sprinkler (50) enlarge.

Figure 6:
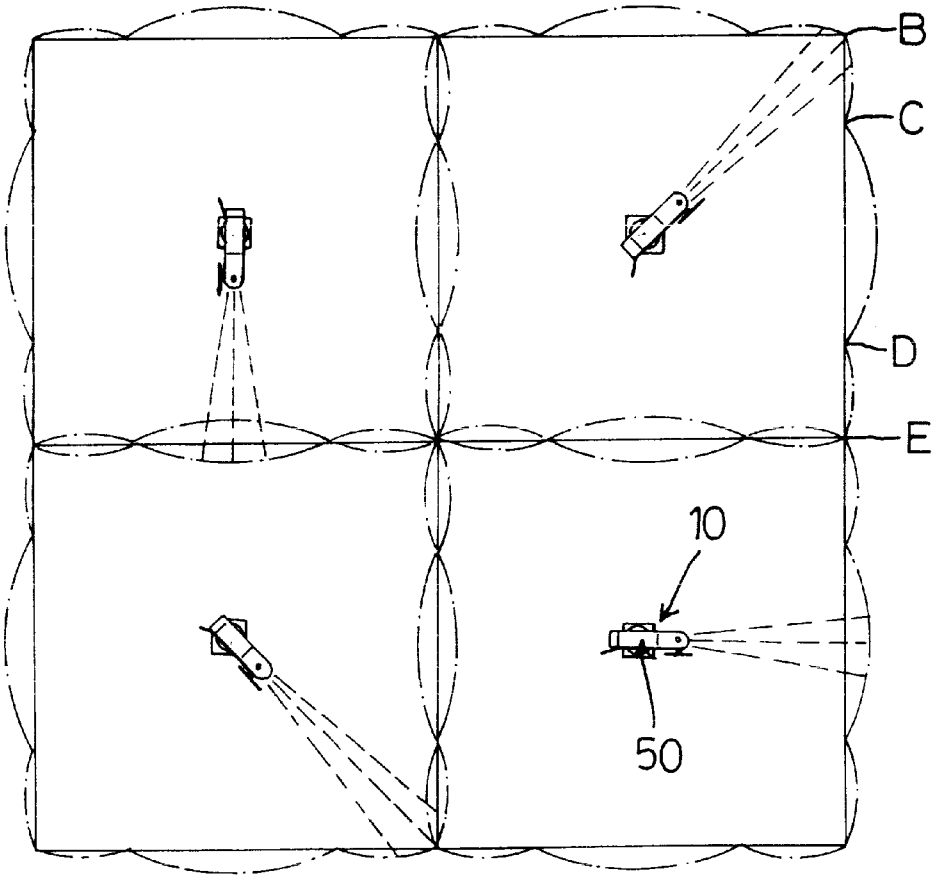
FIG. 6 is a schematic view of a plurality of controlling devices for rotating sprinklers applied in irrigation.
Figure 7:
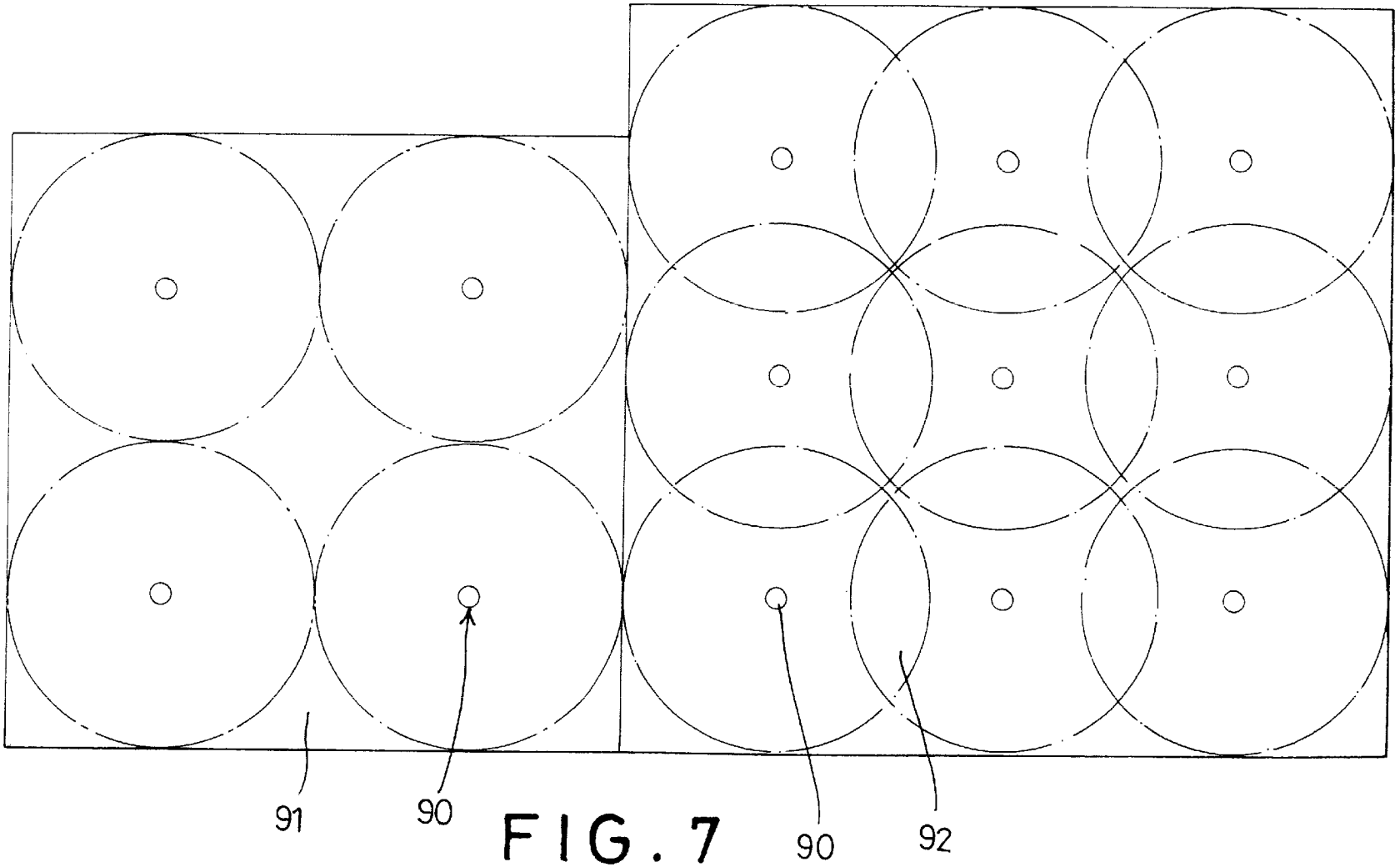
FIG. 7 PRIOR ART
FIG. 7 is a schematic view of two types of conventional rotor-type sprinklers applied in irrigation.

With reference to FIG. 6, the spraying range of this invention is similar to the rectangular range with a stable water supply. At point B, the spraying distance is the longer than other ones at points C and D which means the stubs (244) touch a very top end of the curved surface (236) of the arms (235) and then the quantity of water flowing into the rotating sprinkler (50) is largest. A curve BC means that the stubs (244) slide from the very top end of the curved surface (236) to a foot of the curved surface, and thus the quantity of water shrinks gradually and the spraying distances shorten. A curve CD shows that the stubs (244) move on the top surface of the compressing block (21), and during this period, the quantity of water is fixed and is a smaller amount than any one at points of the curve BC. A curve DE shows a reverse situation of the curve BC wherein the stubs (244) climb from the foot to the top end of the curved surface (236).

In FIG. 6, the overlapped area is efficiently reduced and therefore the problems caused from the excessive overlapped areas in the conventional rotating sprinklers are reduced.

Additionally, the controlling device for a rotating sprinkler makes the spraying range substantially rectangular by controlling variations of water quantity. The curved surface (236) of the arms (235) is changeable in different widths and arcs. Additionally, the number of the arms (235) is selectively chosen in different requirements to achieve different spraying ranges of the rotating sprinkler (50).

Although the invention has been explained in relation to its preferred embodiment, it is to be understood that many other possible modifications and variations can be made without departing from the spirit and scope of the invention as hereinafter claimed.

What is claimed is:

1. A controlling device for a rotating sprinkler secured to a water pipe (60), the controlling device comprising:

a sleeve (10) adapted to be firmly secured to a rotating sprinkler (50) at a first end of the sleeve (10) and to the water pipe (60) at a second end of the sleeve (10), the sleeve (10) having multiple trenches (15) defined in the sleeve (10); and a resisting edge (14) transversally formed in the sleeve (10); and a controlling set (20) comprising:

a spring (22) mounted on the resisting edge (14) of the sleeve (10);

a compressing block (21) mounted on the spring (22) at one end of the compressing block (21) and having an axle hole (211) defined in a center of the compressing block (21), a spring recess (212) defined in the end of the compressing block (21) to communicate with the axle hole (211) and receive part of the spring (22) inside, a cross-recess (213) defined in another end of the compressing block (21) and communicated with the axle hole (211), and multiple ridges (214) formed on an outer periphery of the compressing block (21) to match with the multiple trenches (15) of the sleeve (10) respectively so as to avoid rotation of the compression block (21) relative to the sleeve (10) and allow vertical movement of the compressing block (21) relative to the sleeve (10);

a controller (23) combined with the compressing block (21) and having an axle tube (231) received in the axle hole (211) of the compressing block (21), a waterway (232) defined in the axle tube (231), a first inclined face (233) formed on a top edge of the axle tube (231), four arms (235) protruding from the axle tube (231) near the first inclined face (233) and resting inside the cross-recess (213) of the compressing block (21), each arm (235) having a curved surface (236) formed at a top face thereof, and at least one sub-waterway (234) defined in an outer periphery of the axle tube (231); and a rotator (24) synchronously rotated with the rotating sprinkler (50) and separably mounted on the controller (23), the rotator (24) having a channel (241) defined in the rotator (24) to communicate with the waterway (232) of the controller (23), a second inclined face (242) constructed on a bottom face toward the inclined face (23) to correspond to the first inclined face (233) of the controller (23), four stubs (244) formed at the bottom face of the rotator (24) to selectively touch the curved surface (236) of the controller (23);

wherein when the stubs (244) contact with a top surface of the compressing block (21), the first inclined face (233) of the controller (23) and the second inclined face (242) are connected in a water-tight manner so that water flows through the waterway (232) only; when the stubs (244) contact with the curved surface (236) of the arms (235), the controller (23) and the compressing block (21) are pressed downwardly so that the first inclined face (233) and the second inclined face (242) are separated to construct a gap (A), whereby water flows through the waterway (232) and the at least one sub-waterway (234).

2. The controlling device for a rotating sprinkler as claimed in claim 1, wherein the controlling set(20) further comprising:

a shelter ring (26) sleeving around the rotator (24) and having an aperture (261) to receive the rotator (24) inside, a flange (262) formed on an inner wall of the shelter ring (26) to prevent the rotator (24) moving upwardly and away from the controller (23);

a protruding edge (246) formed on an outer periphery of the rotator (24); and a cushion (25) sandwiched between the protruding edge (246) of the rotator (24) and the flange (262) of the shelter ring (26) to reduce wear and damage between the rotator (24) and the shelter ring (26).

3. The controlling device for a rotating sprinkler as claimed in claim 2, wherein the arms (235) are constructed at isogonal angles of 90 degrees.

4. The controlling device for a rotating sprinkler as claimed in claim 2, wherein the sleeve (10) is a quadratic prism and has the multiple trenches (15) defined at isogonal angles of 90 degrees, and the compressing block (21) has ridges (214) corresponding to the multiple trenches (15) of the sleeve.

5. The controlling device for a rotating sprinkler as claimed in claim 2, wherein the rotator further has two wedges (243) extended upwardly from a top face of the rotator (24), and the rotating sprinkler (50) has two cutouts (53) to correspond to the wedges (243) so as to make the rotator (24) rotate with the rotating sprinkler (50) synchronously.

6. The controlling device for a rotating sprinkler as claimed in claim 1, wherein the arms (235) are constructed at isogonal angles of 90 degrees.

7. The controlling device for a rotating sprinkler as claimed in claim 6, wherein the sleeve (10) is a quadratic prism and has the multiple trenches (15) defined at isogonal angles of 90 degrees, and the compressing block (21) has ridge (214) corresponding to the multiple trenches (15) of the sleeve.

8. The controlling device for a rotating sprinkler as claimed in claim 6, wherein the rotator further has two wedges (243) extended upwardly from a top face of the rotator (24), and the rotating sprinkler (50) has two cutouts (53) to correspond to the wedges (243) so as to make the rotator (24) rotate with the rotating sprinkler (50) synchronously.

9. The controlling device for a rotating sprinkler as claimed in claim 1, wherein the sleeve (10) is quadratic prism and has the trench (15) defined at isogonal angles of 90 degrees, and the compressing block (21) has ridges (214) corresponding to the trench (15) of the sleeve.

10. The controlling device for a rotating sprinkler as claimed in claim 9, wherein the rotator further has two wedges (243) extended upwardly from a top face of the rotator (24), and the rotating sprinkler (50) has two cutouts (53) to correspond to the wedges (243) so as to make the rotator (24) rotate with the rotating sprinkler (50) synchronously.

11. The controlling device for a rotating sprinkler as claimed in claim 1, wherein the rotator further has two wedges (243) extended upwardly from a top face of the rotator (24), and the rotating sprinkler (50) has two cutouts (53) to correspond to the wedges (243) so as to make the rotator (24) rotate with the rotating sprinkler (50) synchronously.

* * * * *